United States Patent [19]

Ueki

[11] Patent Number: 4,666,458

[45] Date of Patent: May 19, 1987

[54] METHOD OF MANUFACTURING A BURNING ACCELERATOR FOR FUEL OILS SUCH AS PETROLEUM

[76] Inventor: Giichi Ueki, 13-3, Higashi-shinagawa 1-chome, Shinagawa-ku, Tokyo 140, Japan

[21] Appl. No.: 837,180

[22] Filed: Mar. 7, 1986

[51] Int. Cl.[4] ..... C10L 1/12; C10L 1/18

[52] U.S. Cl. ..... 44/56; 44/68

[58] Field of Search ..... 44/68, 56

[56] References Cited

U.S. PATENT DOCUMENTS 4,334,979 6/1982 Bertus et al. ..... 208/114

4,386,015 5/1983 Bertus et al. ..... 502/60

4,404,087 9/1983 Reed et al. ..... 208/48 AA 4,439,536 3/1984 Bertus et al. ..... 502/64

*Primary Examiner*—William R. Dixon, Jr.

*Assistant Examiner*—Ellen M. McAvoy

*Attorney, Agent, or Firm*—Wenderoth, Lind & Ponack

[57] ABSTRACT

The present invention offers a burning accelerator for fuel oils such as petroleum or similar combustible substances of that family, which incorporates a uniform mixture composed of organic germanium 32 oxide, alcohols, combustible oils, and surface active agent. Adding the accelerator to the fuel oil enhances the burning rate of the fuel oil.

2 Claims, No Drawings

METHOD OF MANUFACTURING A BURNING ACCELERATOR FOR FUEL OILS SUCH AS PETROLEUM

BACKGROUND OF THE INVENTION

1. Field of the Invention

The present invention relates to a burning accelerator for fuel oils such as petroleum that contributes greatly to minimizing the incompletely burned portion of the fuel oil, thereby enhancing the burning rate of the fuel oil, and more particularly to a method of manufacturing such burning accelerator or improver.

2. Description of the Prior Art

The conventional technologies that help the fuel oils such as petroleum burn efficiently include improved internal combustion engines, improved carburetor nozzles, or the added oxidizer or atomized water. The internal combustion engines or associated parts have been improved primarily to improve the mixture ratio of the fuel oil and air under pressure, or to enhance the flame delivery at the time of the oil combustion, or to minimize the quantity of the exhaust gases that may contain harmful ingredients. As an alternative to the above solution, the added oxidizer or atomized water solution provides the means for enhancing the combustion rate for the fuel oil by supplying the appropriate quantity of oxygen to the fuel oil.

Specifically, the improvements associated with the mechanical parts include those changes in the geometrical shapes for the combustion chamber, nozzles, and inlet or outlet paths. Those changes have been attempted to provide an improved burning efficiency. Since those improvements rely solely upon the engine room or its associated parts for the improved burning efficiency, however, it is actually likely that they raise a problem when the engine is running at high speeds. In that situation, it is known that the fluid becomes viscous, which poses the limitation on further improving the combustion efficiency. For the alternative solution that deals with supplying the appropriate amount of oxygen or other additives to the fuel oil, there is also a problem which makes it difficult to mix those additives with the fuel oil rapidly and uniformly. It is also difficult or practically impossible to control the quantity of those agents to be added, since they might delicately affect the ignition timing and compression ratio within the combustion chamber, depending upon the selected quantity of the additives. Thus, the usage of the additives is limited (the quantity of the additive can only be controlled within the limited allowance, and depends largely upon the nature of the fuel oil and the construction of the engine).

OBJECTS OF THE INVENTION

The principal object of the present invention is to solve the above-described problems by producing a uniform admixture composed of a solution containing organic germanium 32 oxides, and alcohols and petroleums as well as a surface active agent which are added to the solution.

According to the present invention, 1 mg/l or more of organic germanium 32 oxides is dissolved in water, and alcohols (which include the products obtained by oxidation or reduction) are added to the resultant solution. Then, they are mixzed together by stirring, to which mixture solution petroleums or similar substances of that family and the surface active agent are added.

Then, they are mixed together until they form a uniform admixture.

The minimum quantity of the organic germanium 32 oxides such as 1 mg/l, can be effective for the purpose of the invention. As the quantity is increased, it provides the corresponding effect. When it exceeds 200 mg/1, it provides no further effect. For the practical purposes, however, the quantity may be increased up to 1000 mg/1. The range between 50 mg/1 and 500 mg/1 may be optimum in terms of the cost efficiency.

The alcohols contain 20% of methyl alcohol and 80% of ethyl alcohol, which as a whole correspond to 900 ml/l to 300 ml/l. This represents the quantity of alcohols per liter, which may be increased or decreased, depending on the quantities of the other ingredients which are to be added. For the petroleums or similar substances of that family, that quantity may have the range of 50 ml/l and 400 ml/l, and for the surface active agent, the quantity may have the range of 50 ml/l and 300 ml/l. The quantity of water may be sufficient to allow the organic germanium 32 oxides to be dissolved in the water. It may depend upon the quantity of the organic germanium, but should usually range between 5 ml and 20 ml. The alcohols are added so that they can increase the affinity when they are uniformly mixed with the organic germanium. The petroleums or similar substances of that family are added so that they can facilitate the admixture of the burning accelerator of the invention with the fuel oil. The surface active agent is provided so that it can improve the diffusion of the accelerator throughout the fuel oil, thereby allowing it to be mixed with the fuel oil rapidly and uniformly. The amount of the accelerator actually to be used depends upon the kind or nature of the fuel oil. Usually, the value of 100 ppm to 1000 ppm provides a satisfactory effect, and it is proved that for gasoline to be used in the gasoline engine, an amount of approximately 500 ppm provides the desired effect.

It is proved that the organic germanium used in the present invention contributes greatly to reducing the fuel oil particles into finer particles, and that this action increases the contact area between the fuel oil particles and oxygen. It is also proved that the active oxygen contained in the organic germanium lowers the flash or firing point of the fuel oil, thereby accelerating the burning rate of the fuel oil. In addition, it is obsereved that when the amount of the accelerator to be added is more than the specific value, it can improve the rates of atomizing, vaporization, and diffusion for the fuel oil.

The organic germanium 32 oxides that is contained in the burning accelerator according to the present invention is easily dissolved in the water, and the resultant solution can uniformly diffuse throughout the petroleum or similar substances of the family without the risk of segregation. As such, when this accelerator is actually used with the fuel oil, it can rapidly diffuse throughout the fuel oil, and as a result, a uniform mixture can be obtained. Thus, a homogeneous fuel oil is produced.

EXAMPLE 100 mg of organic germanium 32 oxide is dissolved in 10 ml of water, and 770 ml of alcohols (which contain 20% of methyl alcohol and 80% of ethyl alcohol) is added to the resultant solution while they are being stirred. Thus, an uniform admixture is obtained. Then, 100 ml of petroleum or similar substances of that family and 100 ml of surface active agent are gradually added to that uniform admixture while being stirred. The result is the burning accelerator according to the present invention, which is equal to 1000 ml.

When 100 ppm to 1000 ppm of the accelerator is added to the fuel oil, it is proved that it can increase the burning efficiency by 5% to 10%. For the internal combustion engine, its output can be increased by about 10%

Although it has been known that it is difficult to mix the organic germanium oxide with the petroleum or similar substances of that family uniformly, the present invention provides the advantage in that it makes this possible. The organic germanium oxide may be added to those substances with any optional ratios, and the accelerator incorporating the uniform mixture of the germanium oxide and other substances can rapidly diffuse throughout the fuel oil whatever its quantity may be, when it is actually used with the fuel oil.

TEST CASE

Accelerator:

500 ppm is added.

Fuel oil: Gas oil No. 1 offered by Esso Oil.

Calorie of 10,800; specific gravity of 0.8326.

Engine: P1 Model 6BD offered by Isuzu Motors Co.

Capacity of 5785 cc

Output of 85 ps/2100 rpm.

Maximum torque of 31 kgm/1500 rpm.

Test mode: conforms with JIS-D-1005

The test results are as follows:

(1) Maximum torque:

31 kgm/1500 rpm, on which Accelarator is used;

32.5 kgm/1500 rpm, on which Accelarator is not used (2) Output:

84.8 ps/2096 rpm, on which Accelarator is used;

93 ps/2107 rpm, on which Accelarator is not used (3) Fuel consumption during 50 hrs continuous running:

12.68 l/h, on which Accelarator is used;

12.12 l/h, on which Accelarator is not used

The following tables are presented to show the results of the actual testing for the particular car on which the burning accelerator of the invention is used.

Table for Recording the Exhaust Gases Test Results for Gasoline-Engine Vehicles (10 mode and idling)

Date of Testing: Oct. 26, 1985; Weather: clear; Test House: Nippon Jidousha Yuso Gijutu Kyoukai Vehicle Specifications:

| | | | | | |
|---|---|---|---|---|---|
| Car Name: | SUBARU Model E-AB4 | Motor type: | EA81 | Max. Output: | 100/5600 ps/rpm |
| Car No.: | AB4-034436 | Cycles: | 4 | Cylinders: 4 | Total Capacity: 1780 cc |
| Distance Traveled: | 38006 km | Transmission: | automatic, 3 gears | | |
| Total Car Weight: | 1185 kg | Gear ratio: | 3.77 | | |
| Car Wt. under Test: | 1020 kg | Fuel Oil: | Leadless Regular | | |
| Equivalent Inertia Wt.: | 1000 kg | | | | |

Drive wheel tire pneumatic (standard): 1.8 kg/cm$^2$

Drive wheel tire pneumatic (actual measurement): 2.8 kg/cm$^2$

Test Equipment:

Chassi-Dynamo Meter: "BANZAI" BCD-100E

Exhaust gas spectrometer: (idling exhaust gas testing) Horiba MEXA-8320
(10 mode exhaust gas testing) Horiba MEXA-8320

CVS device: Horiba CVS-31 (sampling: 6.18 m$^3$/mm)

©Idling Exhaust Gas Testing:

Room Temperature: 26.0° C.; Coolant Temperature: 82° C.

Atmospheric Pressure: 763.0 mmHg; Lubricant Temperature: 94° C.

| Gear Pos. | Engine Speed rpm | Suction -mmHg | Measured Value (NDIR) CO | HC | $CO_2$ | Concentration Corrected CO | HC |
|---|---|---|---|---|---|---|---|
| N | 660 | 453 | 0.01 ppm % | 11.7 ppm | 10.6% | 0.02 ppm % | 16.0 ppm |
| D | 550 | 410 | 0.01 ppm % | 10.0 ppm | 10.6% | 0.02 ppm % | 13.7 ppm |

10-mode Exhaust Gas Testing:

| | | | | |
|---|---|---|---|---|
| Test Room | Dry Bulb Temp: | 26.0° C.~26.0° C. | Test Car Warmup Start Time: | 9 h:50 m |
| | Wet Bulb Temp: | 16.0° C.~16.0° C. | Coolant Temp: | 82° C.~82° C. |
| | Rel. Humidity: | 34% | Lubricant Temp: | 94° C.~94° C. |
| | Atmos. Pressure: | 763 mmHg | Engine Suction equivalent to Chassi-Dynamo Meter Load: | |

©10-mode Run Start Time: 10 h:20 m

Fuel Consumption: 12.1 km/l

KH (NOx humid. Correct Factor): 0.893

461 mmHg (20 km/h)
453 mmHg (40 km/h)
414 mmHg (60 km/h)

Exhaust Pipe Opening Static Pressure Difference: mmAq (40 km/h)

| Ingredient | Diluted Exhaust Gas Density A | Environ. Density B | Net Density A−[BX(1−1/DF)] | Exhaust Wt. |
|---|---|---|---|---|
| CO(NDIR) | 29.0 ppm | 0.3 ppm | 28.71 ppm | 0.67 g/km |
| HC(FID) | 7.49 ppm C | 2.33 ppm C | 5.26 ppm C | 0.06 g/km |
| NOx(CLD) | 9.47 ppm | 0.02 ppm | 9.45 ppm | 0.32 g/km |
| $CO_2$(NDIR) | 0.57% | 0.03% | 0.54% | 195 g/km |

©Note: Normal Non-load rpm (N) 800 ± 50 rpm, spark timing 13° ± 3°/800 ± 50 BTDC/rpm Table for Recording the Exhaust Gases Test Results for Gasoline-Engine Vehicles (10 mode and idling)

Date of Testing: Nov. 29, 1985; Weather: clear; Test House: Nippon Jidousha Yuso Gijutu Kyoukai Vehicle Specifications:

Car Name: SUBARU Model E-AB4 Motor type:EA81 Max. Output: 100/5600 ps/rpm
Car No.: AB4-034436 Cycles: 4 Cylinders: 4 Total Capacity: 1780 cc
Distance Traveled: 38639 km Transmission: automatic, 3 gears
Total Car Weight: 1185 kg Gear ratio: 3.77
Car Wt under Test: 1020 kg Fuel Oil: Leadless Regular
Equivalent Inertia Wt: 1000 kg
Drive wheel tire pneumatic (standard): 1.8 kg/cm$^2$
Drive wheel tire pneumatic (actual measurement): 2.7 kg/cm$^2$ Test Equipment:

Chassi-Dynamo Meter: "BANZAI" BCD-100E
Exhaust gas spectrometer: (idling exhaust gas testing) Horiba MEXA-8320
(10 mode exhaust gas testing) Horiba MEXA-8320
CVS device: Horiba CVS-31 (sampling: 6.18 m$^3$/mm)

◎Idling Exhaust Gas Testing:

Room Temperature: 27.0° C.; Coolant Temperature: 86° C.
Atmospheric Pressure: 751.7 mmHg; Lubricant Temperature: 105° C.

| Gear Pos. | Engine Speed rpm | Suction -mmHg | Measured Value (NDIR) CO | HC | $CO_2$ | Concentration Corrected CO | HC |
|---|---|---|---|---|---|---|---|
| N | 750 | 472 | 0.01 ppm % | 21.0 ppm | 8.6% | 0.01 ppm % | 35.3 ppm |
| D | 580 | 405 | 0.01 ppm % | 11.0 ppm | 9.2% | 0.01 ppm % | 17.3 ppm |

◎10-mode Exhaust Gas Testing:

Test Room Dry Bulb Temp: 27.0° C.~27.0° C. Test Car Warmup Start Time: 11 h:30 m
Wet Bulb Temp: 15.0° C.~15.0° C. Coolant Temp: 86° C.~86° C.
Rel. Humidity: 24% Lubricant Temp: 105° C.~105° C.
Atmos. Pressure: 751.7 mmHg Engine Suction equivalent to Classi-
10-mode Run Start Time: 12 h:00 m Dynamo Meter Load:
Fuel Consumption: 12.3 km/l 486 mmHg (20 km/h)
KH (NOx humid. Correct Factor): 0.858 459 mmHg (40 km/h)
397 mmHg (60 km/h)
Exhaust Pipe Opening Static Pressure Difference: mmAq (40 km/h)

| Ingredient | Diluted Exhaust Gas Density A | Environ. Density B | Net Density A−[BX(1−1/DF)] | Exhaust Wt. |
|---|---|---|---|---|
| CO(NDIR) | 18.6 ppm | 1.3 ppm | 17.36 ppm | 0.40 g/km |
| HC(FID) | 8.35 ppm C | 2.47 ppm C | 5.99 ppm C | 0.07 g/km |
| NOx(CLD) | 15.10 ppm | 0.09 ppm | 15.01 ppm | 0.48 g/km |
| $CO_2$(NDIR) | 0.58% | 0.04% | 0.54% | 192 g/km |

◎Note: Normal Non-load rpm (N) 800 ± 50 rpm, spark timing 13° ± 3°/800 ± 50 BTDC/rpm The following table is presented to show the result of the actual testing for the particular car on which the burning accelerator of the invention is not used.

Table for Recording the Exhaust Gases Test Results for Gasoline-Engine Vehicles (10 mode and idling)

Date of Testing: Aug. 2, 1985; Weather: clear; Test House: Nippon Jidousha Yuso Gijutu Kyoukai Vehicle Specifications:

Car Name: SUBARU Model E-AB4 Motor type:EA81 Max. Output: 100/5600 ps/rpm
Car No.: AB4-034436 Cycles: 4
Cylinders: 4 Total Capacity: 1780 cc
Distance Traveled: 35428 km Transmission: automatic, 3 gears
Total Car Weight: 1185 kg Gear ratio: 3.77
Car Wt. under Test: 1020 kg Fuel Oil: Leadless Regular
Equivalent Inertia Wt.: 1000 kg
Drive wheel tire pneumatic (standard): 1.8 kg/cm$^2$
Drive wheel tire pneumatic (actual measurement): 1.8 kg/cm$^2$ Test Equipment:

Chassi-Dynamo Meter: "BANZAI" BCD-100E
Exhaust gas spectrometer: (idling exhaust gas testing) Horiba MEXA-8320
(10 mode exhaust gas testing) Horiba MEXA-8320
CVS device: Horiba CVS-31 (sampling: 6.16 m$^3$/mm)

◎Idling Exhaust Gas Testing:

Room Temperature: 23.0° C.; Coolant Temperature: 81° C.

-continued

Table for Recording the Exhaust Gases Test Results for Gasoline-Engine Vehicles (10 mode and idling)

Atmospheric Pressure: 752.5 mmHg: Lubricant Temperature: 100° C.

| Gear Pos. | Engine Speed rpm | Suction -mmHg | Measured Value (NDIR) CO | HC | $CO_2$ | Concentration Corrected CO | HC |
|---|---|---|---|---|---|---|---|
| N | 730 | 480 | 0.02 ppm % | 11.0 ppm | 13.2% | 0.03 ppm % | 12.1 ppm |
| D | 600 | 420 | 0.01 ppm % | 9.8 ppm | 13.2% | 0.01 ppm % | 10.8 ppm |

◎10-mode Exhaust Gas Testing:

Test Room Dry Bulb Temp: 23.0° C.~23.0° C. Test Car Warmup Start Time: 14 h:00 m
Wet Bulb Temp: 18.0° C.~18.0° C. Coolant Temp: 81° C.~81° C.
Rel. Humidity: 62% Lubricant Temp: 100° C.~100° C.
Atmos. Pressure: 752.5 mmHg 10-mode Run Start Time: 14 h:40 m
Fuel Consumption: 9.9 km/l
KH (NOx humid. Correct Factor): 1.006
Engine Suction equivalent to Chassi-Dynamo Meter Load:
430 mmHg (20 km/h)
435 mmHg (40 km/h)
402 mmHg (60 km/h)
Exhaust Pipe Opening Static Pressure Difference: mmAq (40 km/h)

| Ingredient | Diluted Exhaust Gas Density A | Environ. Density B | Net Density A−[BX(1−1/DF)] | Exhaust Wt. |
|---|---|---|---|---|
| CO(NDIR) | 480 ppm | 1.0 ppm | 479.05 ppm | 10.9 g/km |
| HC(FID) | 7.18 ppm C | 2.68 ppm C | 69.26 ppm C | 0.78 g/km |
| NOx(CLD) | 1.55 ppm | 0.01 ppm | 1.54 ppm | 0.06 g/km |
| $CO_2$(NDIR) | 0.66% | 0.04% | 0.62% | 220 g/km |

◎Note: Normal Non-load rpm (N) 800 ± 50 rpm, spark timing 13° ± 3°/800 ± 50 BTDC/rpm The following comparative table is presented to compare the results of the actual testing on which the burning accelerator of the invention is used with the result of the actual testing on which the burning accelerator of the invention is not used.

Comparative table of the Exhaust Gases Test Results for Gasoline-Engine Vehicles and the Fuel Consumption Test Results (10 mode)

Car Name: SUBARU Model E-AB4
Cylces: 4
Cylinders: 4
Total Capacity: 1780 cc
Max. Output: 100/5600 ps/rpm
Transmission: automatic
Test House: Nippon Jidousha Yuso Gijutu Kyoukai

| Data of Testing | | Aug. 2, 1985 | Oct. 26, 1985 | Nov. 29, 1985 |
|---|---|---|---|---|
| Existence of the burning accelerator | | no addition | addition | addition |
| Condition of traveling km | Distance Traveled | 35428 | 38006 | 38639 |
| | Distance Traveled after adding | | 2578 | 3211 |
| Exhaust Wt. g/km | CO | 10.90 | 0.67 | 0.40 |
| | HC | 0.78 | 0.06 | 0.07 |
| | total Wt. | 11.68 | 0.73 | 0.47 |
| Fuel Consumption | km/l | 9.9 | 12.1 | 12.3 |
| | Elongation percentage | 100 | 122.22 | 124.24 |
| Total Wt. of Exhaust Gas | g/l | 115.63 | 8.83 | 5.78 |
| | Variation percentage | 100 | −92.36 | −95.00 |

The above test results demonstrates that the accelerator according to the present invention is effective in terms of the maximum torque, output and fuel consumption. Adding the accelerator cleans the combustion chamber, and reduces the solid deposits there.

Although the present invention has been described with reference to the typical example, it should be understood that various changes and modifications may be made within the scope and spirit of the invention.

What is claimed is:

1. A method of manufacturing a burning accelerator for fuel oils which comprises:

dissolving from 1 mg/l up to 1000 mg/l of organic germanium 32 oxide in water;

adding from 900 ml/l to 300 ml/l of an alcohol component consisting of a mixture of methyl alcohol and ethyl alcohol in a ratio of 1:4 to the resultant solution and mixing the same with said solution; and adding from 50 ml/l to 400 ml/l of a petroleum or similar substance of that family to facilitate the admixture of the accelerator with fuel oil and adding 50 ml/l to 300 ml/l of a surface active agent which improves the diffusion of the accelerator throughout fuel oil to the resultant mixture and mixing them together until they form a uniform mixture solution.

2. A burning accelerator for fuel oil which comprises a uniform solution of a least 1 mg/l up to 1000 mgl/l of organic germanium 32 oxide in water;

from 900 ml/l to 300 ml/l of an alcohol component consisting of a mixture of methyl alcohol and ethyl alcohol in a ratio of 1:4;

from 50 ml/l to 400 ml/l of a petroleum or similar substance of that family which facilitates the admixture of the accelerator with fuel oil; and 50 ml/l to 300 ml/l of a surface active agent which improves the diffusion of the accelerator throughout fuel oil.

* * * * *